United States Patent [19]

Nozaki et al.

[11] 3,998,482

[45] Dec. 21, 1976

[54] LOCK MEANS

[76] Inventors: Yoshiharu Nozaki, 22 6Banwari, Nawa-Cho, Tokai, Aichi; Ichio Ikeda, 45 2-Chome Nakade-Cho, Atsuta, Nagoya, both of Japan

[22] Filed: Dec. 4, 1975

[21] Appl. No.: 637,508

[30] Foreign Application Priority Data

Dec. 18, 1974 Japan ..... 49-146106

[52] U.S. Cl. ..... 292/216; 292/210

[51] Int. Cl.[2] ..... E05C 3/26

[58] Field of Search ..... 292/198, 216, 280, 210, 292/DIG. 23–27, DIG. 4, DIG. 65

[56] References Cited

UNITED STATES PATENTS

| | | | |
|---|---|---|---|
| 350,678 | 10/1886 | Hussey | 292/DIG. 4 |
| 3,697,105 | 10/1972 | Marx | 292/216 |

*Primary Examiner*—Richard E. Moore
*Attorney, Agent, or Firm*—William A. Drucker

[57] ABSTRACT

A lock means for doors of an automobile comprises a lock base, a ratchet which is mounted rotatably on the lock base, is provided with a full-latch claw and a half-latch claw and is biased toward the unlock establishing direction of the lock means, a hindering piece which is overlapped on the ratchet and is movable against the ratchet between an envelope position and a non-envelope position, a holding piece mounted rotatably against the lock base, biased toward the ratchet and adapted to engage with the contours of the overlapped ratchet and the hindering piece and an interconnecting means interposed between the hindering piece and the holding piece and adapted to actuate the holding piece between the envelope and the non-envelope positions. The envelope position is established at the time of a lock-operation when the ratchet is actuated by a striker in the lock establishing direction, the engagement between the half-latch claw and the holding piece becoming impossible and the non-envelope position is established at the time of an unlock-operation when the ratchet is actuated reversely, this engagement becoming possible.

4 Claims, 18 Drawing Figures

LOCK MEANS

BACKGROUND OF THE INVENTION

This invention relates to a lock means for doors of an automobile.

In conventional lock means of this kind, two kinds of situations are established at the time of a lock-operation as well as at the time of an unlock-operation. They are a half-latch and a full-latch situations. The half-latch situation is necessary in order to prevent the lock means from being unlocked in one step by an operation not intended for opening the door. However, the half-latch situation is established in the conventional lock means also at the time of a lock-operation contrary to the original or proper purpose of the half-latch if the lock-operation is incomplete. The half-latch situation is not desirable in the light of driving an automobile and should be established restrictedly when the lock means happens to be unlocked unexpectedly or spontaneously.

The object of the present invention is to provide a lock means in which the half-latch situation is established restrictedly at the time of an unexpected or unintended unlock-operation and is never established at the time of a lock-operation.

SUMMARY OF THE INVENTION

A lock means according to the present invention includes a lock base mountable on a door of an automobile, a rotary shaft supported rotatably by the lock base, a ratchet provided with a half-latch claw and a full-latch claw and carried by the rotary shaft, a hindering piece overlapped on the ratchet and displaced against the ratchet within a certain extent, a holding piece mounted rotatably on the lock base and a tension spring stretched between the holding piece and the hindering piece as an interconnecting means between both pieces. When the ratchet is not so much rotated in the lock establishing direction as to establish the neutral position of the tension spring, the hindering piece is biased by the tension spring to the envelope position where the contour of the hindering piece envelopes the contour of the half-latch claw, to make impossible the engagement of the half-latch claw with the holding piece. When the ratchet is rotated in the lock establishing direction beyond the neutral position of the tension spring, the hindering piece is biased by the inverted force of the tension spring to the non-envelope position where the contour of the hindering piece does not envelope the contour of the half-latch claw, to make possible the engagement between the holding piece and the half-latch claw. The real displacement of the hindering piece due to the force of the tension spring from one to the other of these two positions takes place when the engagement of the holding piece with the hindering piece terminates in the course of the rotation of the ratchet in the unlock establishing direction. Thus, when the ratchet is rotated by the lock-operation in the lock establshing direction, the hindering piece at the envelope position prevents the half-latch claw from engaging with the holding piece and the half-latch situation at the time of the lock-operation is eliminated. If the ratchet is rotated insufficiently by the lock-operation, the ratchet is returned to its original position and the unlock situation is obtained with the hindering piece in the envelope situation. Next, when the hindering piece is separated from the ratchet by a spontaneous operation not intended for unlocking, the engagement of the half-latch claw in the non-envelope position with the returning holding piece becomes possible and the half-latch situation at the time of the unlock-operation is realized. In another embodiment, the displacement of the hindering piece from the envelope position to the non-envelope position or vice versa is effectuated while the hindering piece is actuated against the ratchet.

Thus, the lock means according to the present invention is safe one for the purpose of driving an automobile because only the full-latch situation is established at the time of the lock-operation by a sufficient operation intended for locking and the half-latch situation is established at the time of the unlock-operation by a spontaneous force or a careless operation not intended for the lock-operation. In the drawings, FIG. 1 is a rear view of a lock means;

Figure 1:
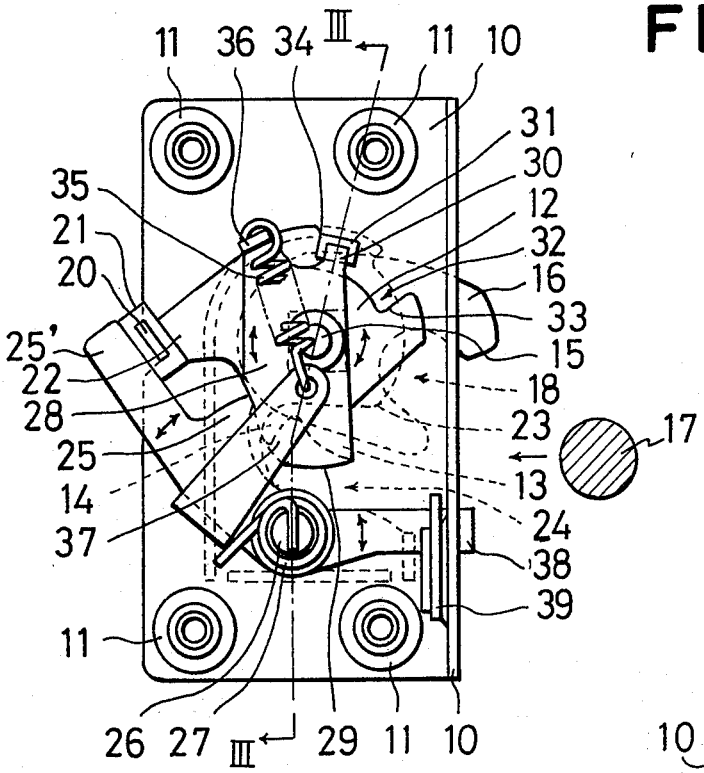
Figure 2:
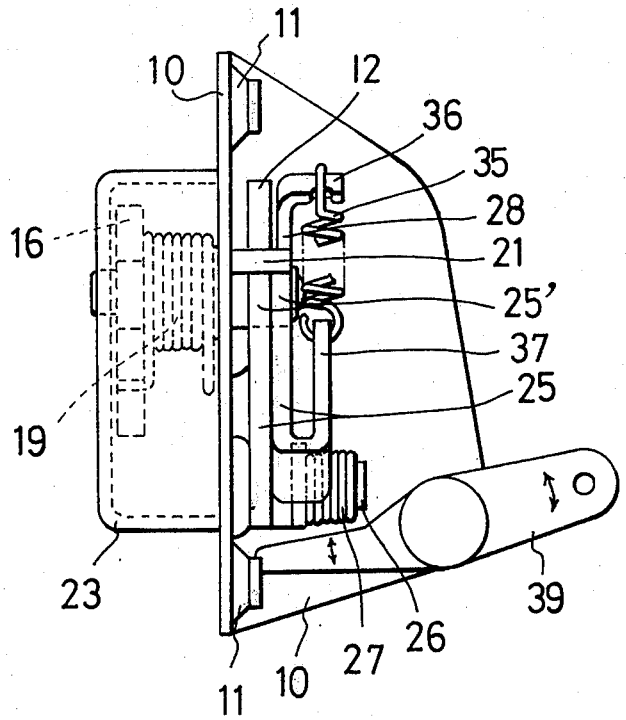
FIG. 2 is a side elevation viewed from the left side of the means in FIG. 1.
Figure 3:
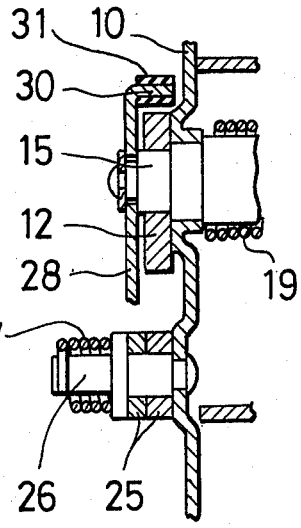
FIG. 3 is an end view taken along a line III — III, showing a ratchet, a holding piece, a hindering piece and an interconnecting means interposed between the hindering piece and the holding piece.

Referring to FIGS. 1–9, a lock base 10 prepared as a base plate is made of a worked up metallic plate such as iron plate. The lock base 10 is provided with mounts 11 for mounting the lock base 10 on a door of an automobile. A ratchet 12 has a full-latch claw 13 and a half-latch claw 14 and is mounted rotatably on the lock base 10 at an integral rotary shaft 15. The half-latch claw 14 is situated in a position leading clockwisely the position of the full-latch claw 13. A lock wheel 16 is mounted on the rotary shaft so that the lock wheel 16 can rotate integrally with the ratchet 12. The lock wheel 16 has also such a fit-in portion 18 at its periphery which has a form suitable for receiving a circular cylindrical striker secured on the main body of the automobile. Because the lock base 10 is attached generally on the end surface of the door of the automobile, the striker 17 is secured on such a frame fitted in the main body which receives the door. A spring 19 is extended between the lock wheel 16 and the lock base 10 and it biases the lock wheel 16 and the ratchet 12 in the counterclockwise and unlock establishing direction in FIG. 1, i.e. in a direction to eliminate the engagement of the striker 17 with the fit-in portion 18. The lock base 10 is provided with a stopper 20 formed by cutting and folding a portion of the lock base. The stopper 20 is covered with a shock absorbing material 21 and a function to stop the ratchet shocklessly at a contact piece 22 attached thereon. A cover 23 is fitted with the lock base 10, covering a locking mechanism therein but the engagement between the lock wheel 16 and the striker 17 is done through an opening 24 formed in the cover 23. A holding piece 25 is mounted rotatably on a shaft 26 set up on the lock base 10. The holding piece 25 and the ratchet 12 are positioned horizontally and vertically so that their peripheries may confront or contact each other. A contact piece 25' formed integrally with the holding piece 25 is stopped by the stopper 20 and prevents the excessive rotation of the holding piece 25. A coil spring 27 is mounted around the shaft 26 and biases the holding piece 25 towards the ratchet 12. A hindering piece 28 is adapted loosely around the rotary shaft 15 and a hindering surface 29 on the periphery of the hindering piece 25 is made suitable to contact with the periphery of the holding piece 25. The contour of the hindering surface 29 has a form suitable to envelope the contours of the half-latch claw 14 and the full-latch claw 13. The hindering piece 28 is provided with a contact piece 30 made by cutting and folding some part of the hindering piece 28 and further, this contact piece is covered with a shock absorbing member 31. On the other hand, the ratchet 12 is provided with a rotation limiter 32 made by cutting off some part of the periphery of the ratchet 12 and the contact piece 30 is adapted in this rotation limiter 32. The rotation of the hindering piece 28 relative to the ratchet is restricted to within the circumferential length of the rotation limiter 32 as the result of the engagement of the contact piece 30 with an end surface 33 or the other 34 of the rotation limiter 32. As an interconnecting means between the hindering piece 28 and the holding piece 25, a tenson spring 35 is stretched between a hook 36 formed as a portion of the hindering piece 28 and another hook 37 fixed on the holding piece 25. When the ratchet 12 is rotated clockwisely in such a degree that the neutral position of the spring 35 is not yet established, the tension spring 35 biases the hindering piece 28 in a direction opposite to the rotation of the ratchet and when the ratchet 12 is rotated clockwisely beyond a position where the neutral position of the spring 35 is established, the tension spring 35 biases the hindering piece in the direction of the rotation of the ratchet 12. The neutral position of the spring 35 is attained while the holding piece 25 is in contact engagement with the hindering surface 29. A trip lever 38 is formed integrally with the holding piece 25 as its prolongation and a release lever 39 pivotally supported on the lock base 10 is jointed to the trip lever 38. The release lever 39 is connected with the knob of the door of the automobile in a well-known manner.

Figure 4:
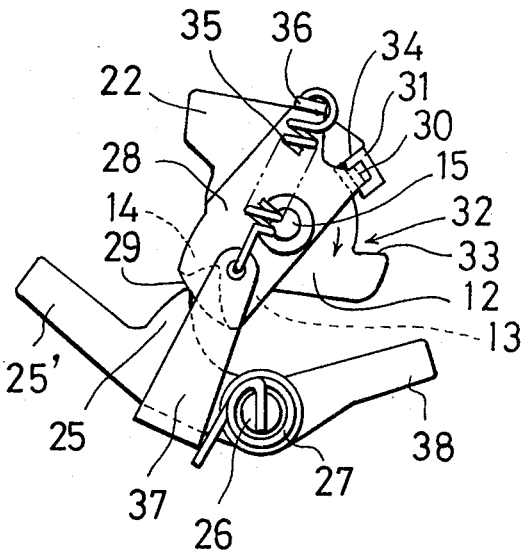
FIGS. 4–6 are views for explaining the operation of the lock means at the time of a lock-operation.
Figure 5:
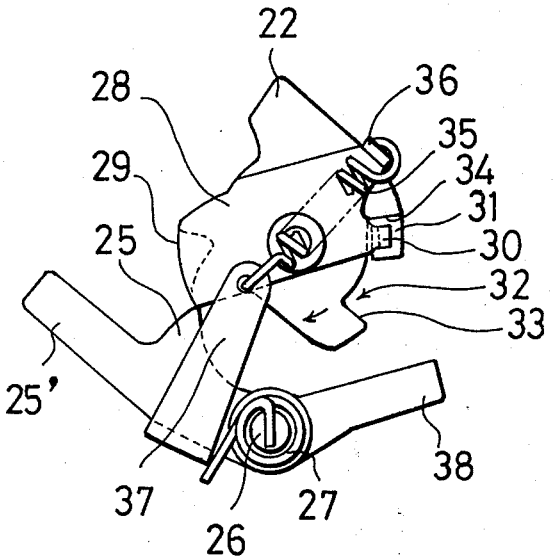
Figure 6:
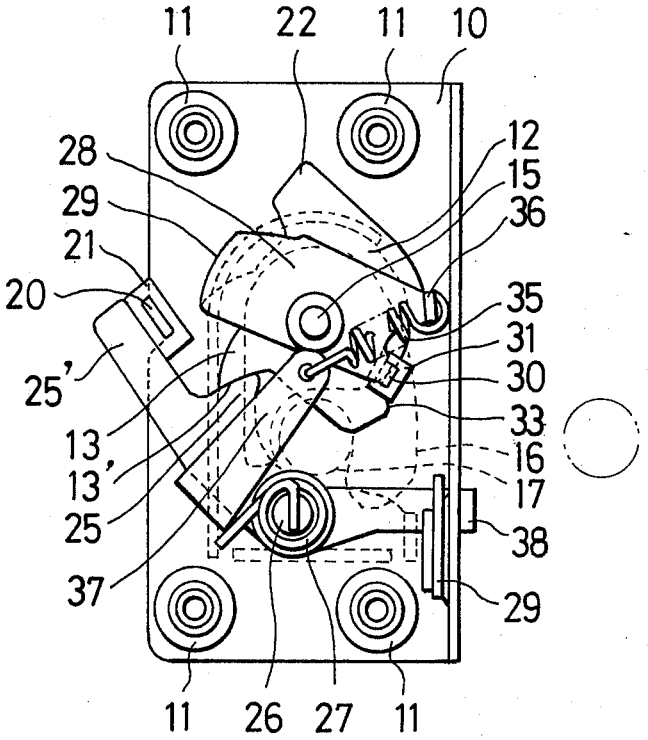

The operation of the lock means described above is as follows. The operation is described first for the case when the door of the automobile is shut. As the result of an operation to shut the door, the striker 17 moves into the fit-in portion 18 of the lock wheel 16 and rotates the lock wheel 16 and the ratchet 12 clockwisely. Because the neutral position of the tension spring 35 is not yet established in this situation, the hindering piece 28 is subjected to the clockwise biasing force due to the spring 35. However, the rotation of the hindering piece 28 by this biasing force is prevented at the contact piece 30 by the end surface 34 of the rotation limiter 32. The hindering piece 28 is rotated clockwisely together with the ratchet 12 by the driving force of the lock wheel 16 exceeding the forces of the springs 19, 27 and 35. In the course of this rotation, the hindering piece 28 remains overlapped on the full-latch claw 13 and the half-latch claw 14 and is established a situation where the contour defining the half-latch claw 14 and the full-latch claw 13 is enveloped by the hindering surface 29. This situation is referred to as the envelope situation hereafter and the hindering piece 28 in this position is said to be in the envelope position. At the same time, the holding piece 25 engages with the overlapped ratchet 12 and the hindering piece 28 and accordingly is rotated counterclockwisely by a driving force from the lock wheel 10. As the rotation of the overlapped ratchet 12 and the hindering piece 28 proceeds further, a situation, where the engagement between the hindering surface 29 and the holding piece 25 is going to finish as shown in FIG. 5, is established through a situation as shown in FIG. 4. In the situation shown in FIG. 5, the tension spring 35 is already in a position beyond its neutral position. If the ratchet 12 is rotated further as shown in FIG. 6, the engagement between the hindering piece 28 and the holding piece 25 disappears and the hindering piece 28 is rotated clockwisely with respect to the ratchet 12 by the force of the spring 35 already inverted by this time until the contact piece 30 is stopped by the end surface 33 of the rotation limiter 32. As the result of this rotation, the contour defining the half-latch claw 14 and the full-latch claw becomes not to be enveloped by the contour of the hindering surface 29. This situation is referred to as the non-envelope situation. Together with this situation, is established a complete lock situation where the holding piece 25 engages with the rear surface 13' of the full-latch claw 13 under the force of the coil spring 27. At this time, the door of the automobile is shut completely. When the door is thus closed and the holding piece 25 is in engagement with the full-latch claw 13, the engaging holding piece 25 and full-latch claw 13 are held securely in the positions shown in FIG. 6 as the result of the balance of the counterclockwise biasing force of the spring 19 and the clockwise one of the coil spring 27. In this case, the excessive rotation of the holding piece 25 towards the ratchet 12 is prevented by the contact of the contact piece 25' with the stopper 20. If the force to actuate the lock wheel 10, i.e. the force to close the door becomes insufficient or disappears during the time interval from the beginning of the engagement between the striker 17 and the lock wheel 16 to the establishment of the engagement between the holding piece 25 and the full-latch claw 13, i.e. in the time interval when the holding piece 25 is in contact with the hindering surface 29, the ratchet 12 in the non-envelope situation and the hindering piece 28 are returned by the force of the spring 19 to the situation shown in FIG. 1. Thus, the so-called half-latch situation is not established when the door is closed.

Figure 7:
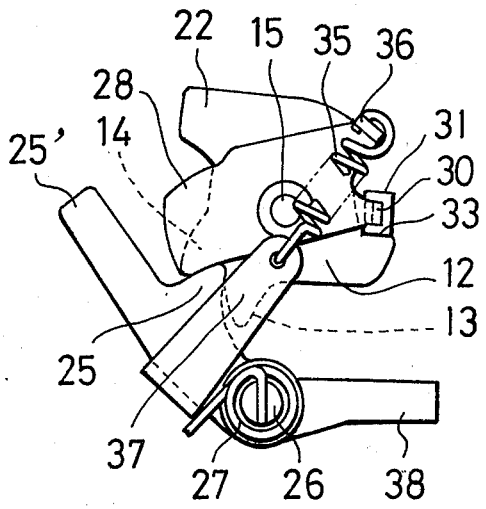
FIGS. 7–9 are views for explaining the operation of the lock means at the time of an unlock-operation.
Figure 8:
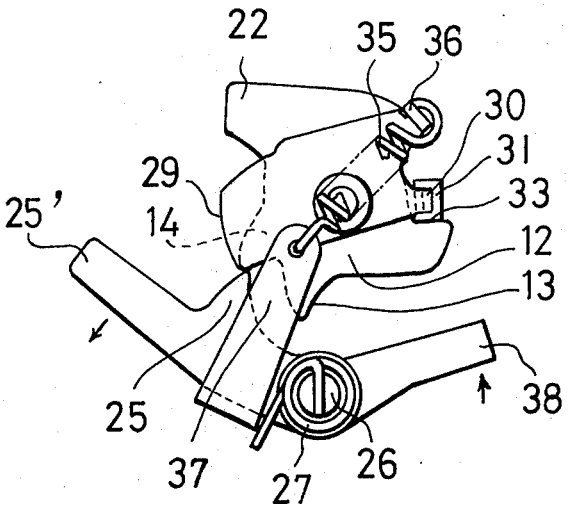
Figure 9:
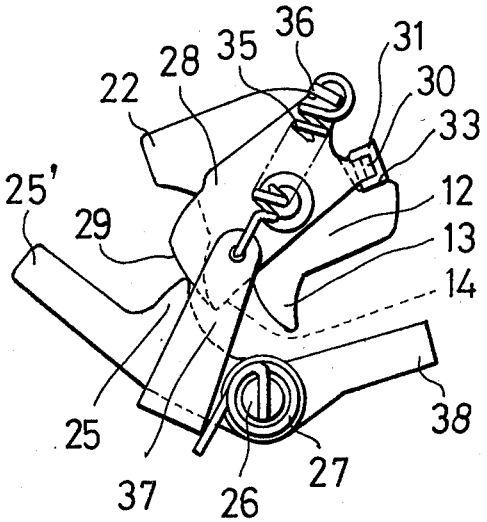

Next, the operation of the lock means is described for the case when the door is opened and the lock means is unlocked. Now, suppose that some part of a human body touches the knob of the door carelessly or a child operates the knob for fun when the holding piece 25 is in engagement with the full-latch claw 13. Then, the release lever 39 cooperating with the knob is operated and actuate the holding piece 25 through the trip lever 38 to separate the holding piece 25 from the full-latch claw 13. As the result of this, the restraint of the ratchet 12 is eliminated and rotated counterclockwisely by the force of the spring 19. However, the operating force exerted on the knob disappears usually when the ratchet 12 is rotated to some extent because the operation at this time upon the knob is not done for the purpose of opening the door. Here, the holding piece 25 is approached towards the ratchet 12 by the force of the coil spring 27 and the ratchet 12 in the non-envelope position at this time engages with the half-latch claw 14, the half-latch situation as shown in FIG. 7 being established. In order to open the door in the half-latch situation intendedly, the knob is operated. The holding piece 25 is rotated again counterclockwisely as shown in FIG. 8, the engagement between the holding piece 25 and the half-latch claw 14 is eliminated, the ratchet 12 and the hindering piece 28 are rotated counterclockwisely and the situation shown in FIG. 1 is established again through the situation shown in FIG. 9. In the situation shown in FIG. 9, the spring 35 is in its neutral position and if the hindering piece 28 is rotated further counterclockwisely, the inversion of the force of the spring 35 occurs. Thus, as soon as the engagement between the hindering piece 28 and the holding piece 25 disappears, the hindering piece 28 is rotated counterclockwisely with respect to the ratchet 12 and the envelope situation is established again.

Figure 18:
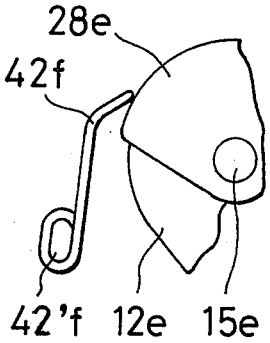
FIG. 18 is a view showing the relationship between a hindering piece and the stopping end of a spring.

Next, referring to FIGS. 10–17, a different embodiment is described. In this embodiment, a fit-in portion 18*e* to receive a striker 17*e* is contained in a double lock base 10*e*. The lock means of this type is called an in-type lock means. On the contrary, the previous embodiment is called an on-type lock means because the fit-in portion 18 is situated on the lock base 10. In the present embodiment, also the interconnecting means interposed between a hindering piece 28*e* and a ratchet 12*e* is different. Those members in this embodiment that are identical with or similar to those in the previous embodiment are given the same reference numerals with a suffix *e* as in the previous embodiment. A holding piece 25*e* is provided with a set up pin 40 and this pin is passed through a hole 41 bored through one side member of the double lock base 10*e*. A biasing end 43 of a spring 42 mounted around a shaft 26*e* engages with the pin 40 and a stopping end 44 of the spring 42, with the periphery of the hindering piece 28*e*. Thus, the holding piece 25*e* is biased so as to approach to the ratchet 12*e* and the hindering piece 28*e* is prevented from rotating about a shaft 15*e* spontaneously. As is shown in FIG. 18, a free end 44*f* of the spring 42 with its one end secured on the lock base 10*e* may be substituted for the stopping end 44 of the spring 42 if the free end 44*f* is pressed on the hindering piece 28*e*. A stopping piece 45 covered with a shock absorbing material 46 is set up on the lock base 10*e* and is also adapted to stop a contact piece 25'*e*. A locking lever 47 is pivoted on a shaft 26*e* for swinging movement in the direction shown by an arrow 48 and is connected at its through hole to the end extreme of a trip lever 38*e*. Thus, the locking lever 47 can swing the trip lever 38*e* connected to a release lever 39*e* in the direction shown by an arrow 49. The locking lever 47 is connected to a door-lock knob in a well-known manner.

Figure 10:
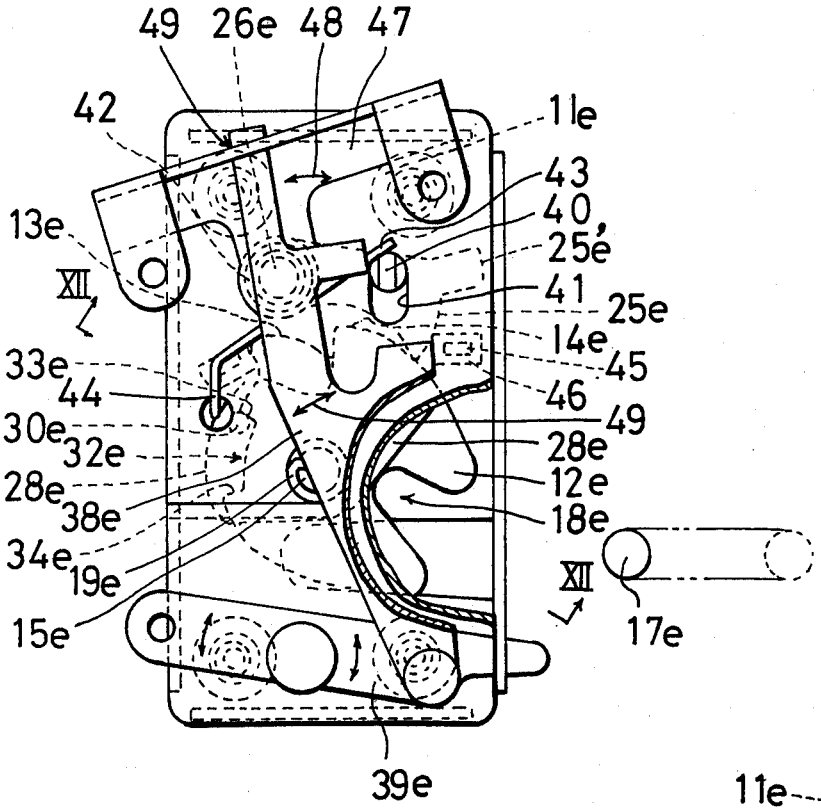
FIG. 10 is a rear view in partial cross-section of another embodiment.
Figure 11:
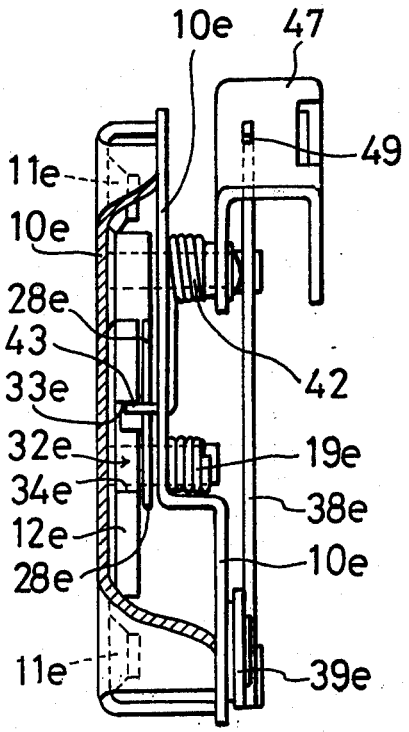
FIG. 11 is a side elevation viewed from the left side of the means in FIG. 10.
Figure 12:
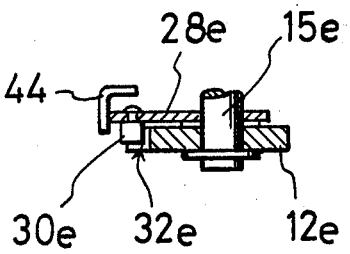
FIG. 12 is a cross-section taken along a line XII — XII, showing a ratchet, a hindering piece and a stopping end.
Figure 13:
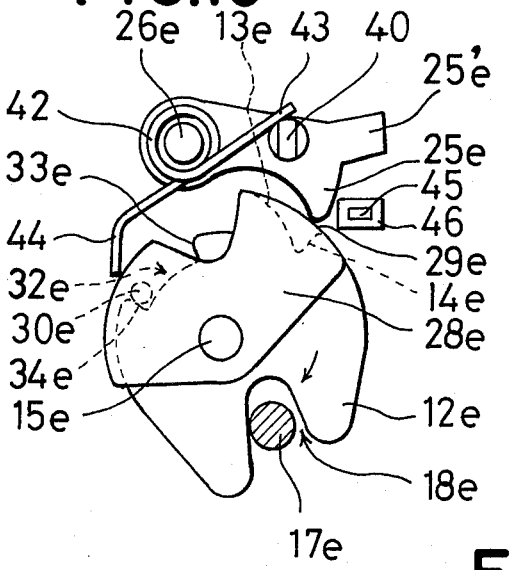
FIGS. 13–15 are views for explaining the operation of the means in FIG. 10 at the time of the lock-operation.
Figure 14:
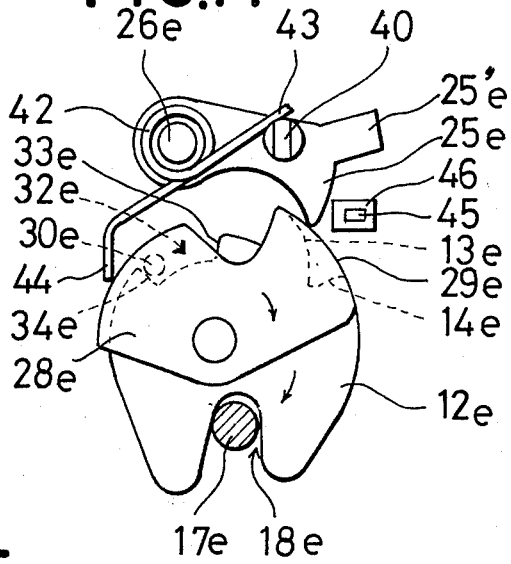
Figure 15:
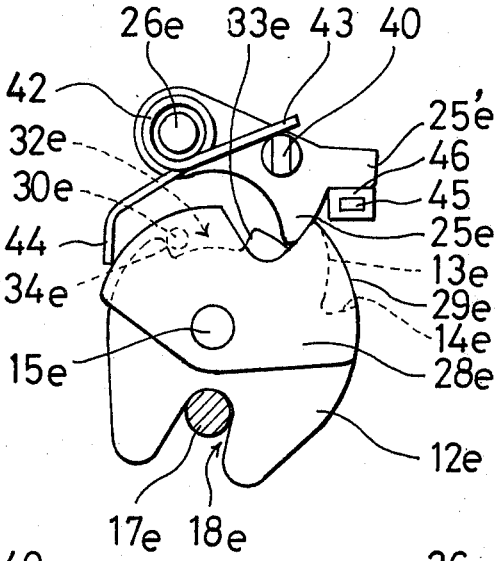
Figure 16:
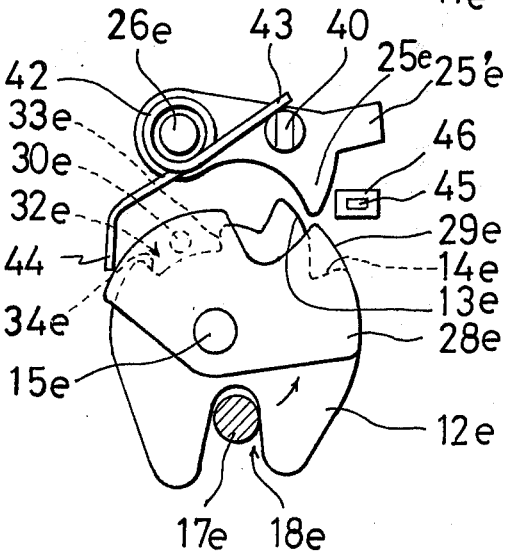
FIGS. 16–17 are views for explaining the operation of the means in FIG. 10 at the time of the unlock-operation.
Figure 17:
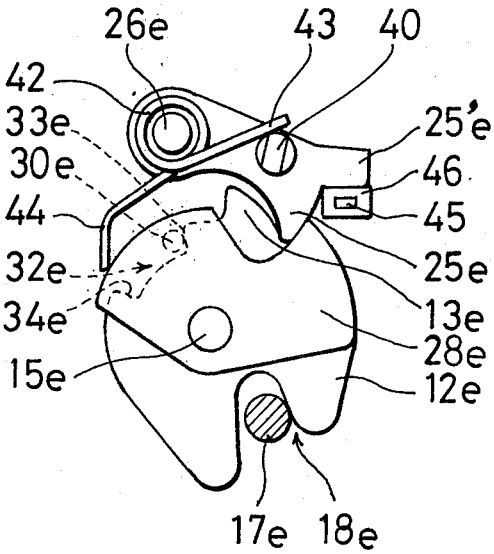

The operation of the lock means having the construction just described is as follows. In the arrangement as shown in FIG. 10, let the striker 17*e* approach the fit-in portion 18*e* and the ratchet 12*e* be rotated clockwisely. Then, as the hindering piece 28*e* is pressed by the stopping end 44 of the spring 42, only the ratchet 12*e* is rotated. Thus the envelope situation is established and the engagement between the holding piece 25*e* and the half-latch claw 14*e* is prevented. If the ratchet 12*e* is rotated further clockwisely, a contact piece provided on the hindering piece 28*e* contacts the end surface 34*e* of a rotation limiter 32*e*, the hindering piece 28*e* begins to rotate with the ratchet 12*e* and the full-latch claw 13*e* engages with the holding piece 25*e* as shown in FIG. 15 through the situation shown in FIG. 14. When the driving force to the ratchet 12*e* disappears during this lock operation, the holding piece 25*e* is returned to the situation of FIG. 10 without engaging with the half-latch claw 14*e* because of the envelope position of the hindering piece 28*e* as in the case of the previous embodiment. Next, suppose that the holding piece 25*e* is separated from the ratchet 12*e* by an operation to open the door in the situation shown in FIG. 15. At this time, only the ratchet 12*e* is rotated counterclockwisely and the non-envelope situation associated with the half-latch claw 14*e* and the full-latch claw 13*e* is established as shown in FIGS. 16 and 17. When the holding piece 25*e* is returned toward the ratchet 12*e*, the engagement between the holding piece 25*e* and the half-latch claw 14*e* is established as shown in FIG. 17. If the holding piece 25*e* is separated from the ratchet 12*e* by an operation to open the door, the ratchet 12*e* is returned to the situation shown in FIG. 10. On the way of this returning process, the contact piece 30*e* contacts the end surface 33*e* and also the hindering piece 28 is rotated counterclockwisely, returning to the situation shown in FIG. 10. In the present embodiment, the ratchet 12*e* must be adapted loosely around the rotary shaft 15*e* if the rotary shaft 15*e* is secured on the lock base 10*e*.

What we claim is:

1. A lock means for doors of an automobile comprising a lock base mountable on the door of the automobile, a rotary shaft supported by the lock base, a ratchet mounted on the rotary shaft and provided with a full-latch claw and a half-latch claw, said ratchet having a form suitable to be actuated by a striker attached on the body of the automobile in a lock establishing direction, said full-latch claw and said half-latch claw being formed on the periphery of the ratchet so that the latter claw may lead the former claw when said ratchet is rotated in the lock establishing direction, a hindering piece overlapped on the ratchet and adapted loosely around said rotary shaft, a holding piece engageable at its periphery with the periphery of the overlapped ratchet and hindering piece and supported rotatably by said lock base, said hindering piece being related to said ratchet so that the hindering piece may rotate between an envelope position and a non-envelope position, in said envelope position said hindering piece enveloping the contour of said half-latch claw to eliminate the engagement between said half-latch claw and said holding piece, in said non-envelope position said hindering piece not enveloping the contour of said half-latch claw to allow the engagement between said half-latch claw and said holding piece, a first biasing means to bias said ratchet against said lock base in the unlock establishing direction, a second biasing means to bias said holding piece to let the same approach said ratchet, and an interconnecting means interposed between said holding piece and said hindering piece, said interconnecting means being constructed so that it can actuate said hindering piece from said envelope position to said non-envelope position after the substantial rotation of the ratchet in the lock establishing direction and actuate said hindering piece from the non-envelope position to the envelope position after the substantial rotation of the ratchet in the unlock establishing direction.

2. A lock means for doors of an automobile comprising a lock base mountable on the door of an automobile, a rotary shaft supported rotatably by the lock base, a lock wheel mounted on said rotary shaft, a ratchet mounted on the rotary shaft and provided with a full-latch claw and a half-latch claw, said ratchet having a form suitable to be actuated by a striker attached on the body of the automobile in a lock establishing direction, said full-latch claw and said half-latch claw being formed on the periphery of the ratchet so that the latter claw may lead the former claw when said ratchet is rotated in the lock establishing direction, a hindering piece having a contact piece, overlapped on the ratchet and adapted loosely around said rotary shaft, a holding piece engageable at its periphery with the periphery of the overlapped ratchet and hindering piece and supported rotatably by said lock base, a first biasing means to bias said ratchet against said lock base in the unlock establishing direction, a second biasing means to bias said holding piece to let the same approach said ratchet, and a tension spring stretched between said holding piece and said hindering piece, said contact piece being received in a rotation limiter formed by cutting off some part of the periphery of said ratchet, thereby the rotation of said hindering piece relative to said ratchet being limited, said tension spring biasing said hindering piece to an envelope position where said hindering piece envelopes the contour of said half-latch claw to eliminate the engagement between said holding piece and said half-latch claw when said ratchet is rotated in the lock establishing direction in such a degree that the neutral position of said tension spring is not yet attained, said tension spring biasing said hindering piece with its inverted force to a non-envelope position where said hindering piece does not envelope the contour of said half-latch claw to allow the engagement between said holding piece and said half-latch claw when the ratchet is rotated in the lock establishing direction beyond the neutral position of said tension spring, the displacement of said hindering piece due to the force of said tension spring from the envelope position to the non-envelope position or vice versa taking place in the course of the rotation of the ratchet in the lock or unlock establishing direction at the termination of the engagement between the holding piece and the hindering piece.

3. A lock means for doors of an automobile comprising a lock base, a rotary shaft supported by said lock base, a ratchet mounted on the rotary shaft and provided with a full-latch claw and a half-latch claw, said ratchet having a form suitable to be actuated by a striker attached on the body of the automobile in a lock establishing direction, said full-latch claw and said half-latch claw being formed on the periphery of the ratchet so that the latter claw may lead the former claw when said ratchet is rotated in the lock establishing direction, a hindering piece having a contact piece, overlapped on the ratchet and adapted loosely around sad rotary shaft, a holding piece engageable at its periphery with the periphery of the overlapped ratchet and hindering piece and supported rotatably by said lock base, a first biasing means to bias said ratchet against said lock base in the unlock establishing direction, a second biasing means to bias said holding piece to let the base approach said ratchet, part of said second biasing means being connected to said hindering piece for preventing the spontaneous free rotation of said hindering piece, said contact piece being received in a rotation limiter formed by cutting off some part of the periphery of said ratchet, thereby the rotation of said hindering piece relative to said ratchet being limited to between an envelope position and a non-envelope position, said envelope position being one where sad hindering piece envelopes the contour of said half-latch claw to eliminate the engagement between said holding piece and said half-latch claw, said non-envelope position being one where said hindering piece does not envelope the contour of said half-latch claw to allow the engagement between said holding piece and said half-latch claw while the ratchet is rotated in the unlock establishing direction, said hindering piece being actuated from said non-envelope position to said envelope position as the result of the engagement of said contact piece with one end surface of said rotation limiter while said ratchet is rotated in the lock establishing direction, said hindering piece being actuated from said envelope position to said non-envelope position while said ratchet is rotated in the unlock establishing direction.

4. A lock means for doors of an automobile as described in claim 3 which includes an independent biasing member for preventing the free rotation of said hindering piece.

* * * * *